US008973287B2

(12) United States Patent
Shibata et al.

(10) Patent No.: US 8,973,287 B2
(45) Date of Patent: Mar. 10, 2015

(54) SHOE MIDSOLE AND FOOTWEAR

(75) Inventors: Osamu Shibata, Tokyo (JP); Masao Shibata, Tokyo (JP)

(73) Assignee: Himiko Co., Ltd., Shibuya-Ku, Tokyo ( * ) Notice: Subject to any disclaimer, the term of this patent is extended or adjusted under 35 U.S.C. 154(b) by 562 days.

(21) Appl. No.: 12/737,806

(22) PCT Filed: Jun. 11, 2009

(86) PCT No.: PCT/JP2009/002644

§ 371 (c)(1),
(2), (4) Date: Feb. 17, 2011

(87) PCT Pub. No.: WO2010/023793

PCT Pub. Date: Mar. 4, 2010

(65) Prior Publication Data

US 2011/0131834 A1 Jun. 9, 2011

(30) Foreign Application Priority Data

Aug. 27, 2008 (JP) ..... 2008-217682

(51) Int. Cl.

| | |
|---|---|
| ***A43B 13/38*** | (2006.01) |
| ***A43B 5/00*** | (2006.01) |
| ***A43B 13/18*** | (2006.01) |
| ***A43B 13/00*** | (2006.01) |
| ***A43B 7/14*** | (2006.01) |
| ***A43B 13/20*** | (2006.01) |

(52) U.S. Cl.

CPC ..... *A43B 13/189* (2013.01); *A43B 7/144* (2013.01); *A43B 7/1445* (2013.01); *A43B 7/146* (2013.01); *A43B 13/20* (2013.01)

USPC ..... 36/44; 36/141; 36/28; 36/25 R

(58) Field of Classification Search

CPC ..... A43B 13/20; A43B 13/203

USPC ..... 36/141, 28, 181, 7.8, 30 R

See application file for complete search history.

(56) References Cited

U.S. PATENT DOCUMENTS

| | | | | |
|---|---|---|---|---|
| 3,087,262 | A * | 4/1963 | Russell | 36/28 |
| 4,934,070 | A | 6/1990 | Mauger | |
| 5,189,816 | A | 3/1993 | Shibata | |
| 5,365,678 | A * | 11/1994 | Shibata | 36/29 |
| 5,768,806 | A * | 6/1998 | Parisotto | 36/103 |
| 6,367,174 | B1 * | 4/2002 | Shibata | 36/141 |
| 6,625,902 | B2 * | 9/2003 | Yamamoto | 36/3 B |

FOREIGN PATENT DOCUMENTS

| | | |
|---|---|---|
| EP | 0 336 801 | 10/1989 |
| FR | 2 591 441 | 6/1987 |

(Continued)

*Primary Examiner* — Khoa Huynh
*Assistant Examiner* — Timothy K Trieu
(74) *Attorney, Agent, or Firm* — Jordan and Hamburg LLP

(57) ABSTRACT

A shoe midsole has a sole plate, a plurality of blades integrally standing on the sole plate, a cover bonded to the circumference of the sole plate, and a fluid sealed between the sole plate and the cover. A first concave part in a shape equivalent to a sole of a foot is formed on the surface of the sole plate, on which the plurality of blades stand, wherein the plurality of blades are accommodated within the first concave part. The plurality of blades are aligned at a predetermined interval in a direction nearly orthogonal to the longitudinal direction of the sole plate, and some of the plurality of blades are tilted toward the toe.

16 Claims, 11 Drawing Sheets

(56) References Cited

FOREIGN PATENT DOCUMENTS

| | | |
|---|---|---|
| JP | 1-284205 | 11/1989 |
| JP | 4-187101 | 7/1992 |
| JP | 6-91849 | 11/1994 |
| JP | 1959712 | 8/1995 |
| JP | 10-295402 | 11/1998 |
| JP | 2000-236908 | 9/2000 |
| JP | 3081377 | 11/2001 |

* cited by examiner

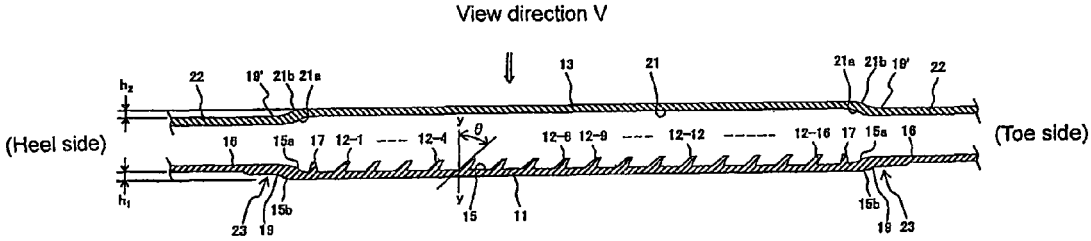
Fig. 3
Fig. 4
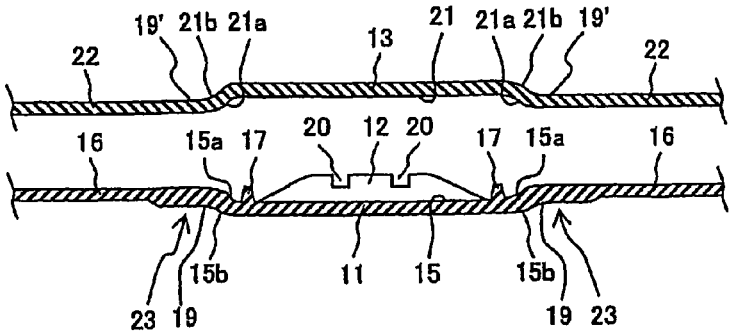

SHOE MIDSOLE AND FOOTWEAR

FIELD OF THE INVENTION

The present invention relates to a shoe midsole and footwear which can absorb a shock during walking while producing a walking feeling of stability and comfort, reduce a load on a foot, a knee, etc. in a standing position, and stimulate a sole of a foot to be massaged.

BACKGROUND OF THE INVENTION

It is conventionally believed that when a heel touches down on the ground, the shock applied to the heel is approximately 1.25 times higher than the human body weight during walking, and approximately three times higher than the human body weight during jogging. This shock is sequentially sent to the heel, an ankle, a knee, and hips.

Conventionally, a sole made of an elastic material is known as a shoe midsole for absorbing the shock applied when the heel touches down the ground. This elastic material absorbs the shock in the contacting area to the ground when the heel touches down on the ground.

Accordingly, the present applicant has proposed a technical means to spread and absorb the shock when the sole of a foot touches down on the ground during walking, and to stimulate the sole of a foot to be massaged (for example, see Patent Document 1).

Patent Document 1 disclosed that a fluid infused between a sole plate and a cover could spread and absorb the shock when the sole of a foot touched down on the ground, and could reduce a load on a knee, hips, etc. Patent Document 1 also disclosed the effect that the shock to the sole of a foot could be spread and absorbed with the fluid smoothly moved by uniformly tilting a plurality of blades toward the heel side, and the effect that the blades could massage the sole of a foot.

By the way, when we human being walk, we take a series of actions as follows: to contact with the ground as the first action, gradually contact a sole with the ground from the heel to the roots of toes as the next action, and to kick the ground with the toes as the last action. This series of actions is continuously repeated as one cycle of the actions.

Until now, it has been considered that the peak impact force is generated at the moment when the heel touches down on the ground within the one cycle of walking. However, it has been revealed that the impact force generated at the moment of kicking the ground of the roots of the toes is higher than the impact force generated at the moment of touchdown of heel on the ground as a simulation described later in FIG. 6.

However, according to the Patent Document 1 described above, the plurality of blades were uniformly tilted toward the heel side and it meant that the plurality of blades were same as the moving direction of the fluid at the moment of kicking the ground of the roots of the toes. Therefore, the fluid in the toe side is quickly moved to the heel side, and there is some risk, that the shock applied to the heel side is increased.

[Patent Document 1] U.S. Pat. No. 1,959,712 (Examined Patent Publication No. H6-91849)

DISCLOSURE OF THE INVENTION

The present invention provides a shoe midsole and footwear which can relieve a shock applied to a sole of a foot during walking, reduce a load on a knee, etc. during walking, and massage the sole of the foot.

SUMMARY OF THE INVENTION

A shoe midsole according to the present invention has a sole plate, a plurality of blades standing on the sole plate, a cover bonded to an outer circumference of the sole plate, and a fluid sealed between the sole plate and the cover. In the shoe midsole, a first concave part in a shape equivalent to a sole of a foot is formed on a surface of the sole plate, on which the plurality of blades stand, therefore, the plurality of blades are accommodated within the first concave part and are arranged at a predetermined interval in a direction nearly orthogonal to the longitudinal direction of the sole plate, and at least some of the blades are tilted toward a toe.

A footwear according to the present invention has a footwear midsole which is placed on a footwear base and comprises a sole plate, a plurality of blades integrally standing on the sole plate, a cover bonded to the outer circumference of the sole plate, and a fluid sealed between the sole plate and the cover. In this footwear, a first concave part in a shape equivalent to a sole of a foot is formed on a surface of the sole plate, on which the plurality of blades stand, and the plurality of blades that are accommodated within the first concave part are aligned at predetermined intervals in a direction nearly orthogonal to the longitudinal direction of the sole plate, and at least some of the blades are tilted toward a toe.

EFFECT OF THE INVENTION

According to the present invention, the shoe midsole and footwear can control the fluid movement during walking and can massage the sole of a foot with the plurality of blades.

BRIEF DESCRIPTION OF THE DRAWINGS

FIG. 3 is a fragmentary cross-sectional view of the sole plate and a cover when being cut along a longitudinal direction of the sole plate, FIG. 4 is a fragmentary cross-sectional view of the sole plate and the cover when being cut along an orthogonal direction to the longitudinal direction of the sole plate.

BEST MODE FOR CARRYING OUT THE INVENTION

The First Embodiment

The first embodiment according to the present invention is described below by using the drawings.

Figure 1:
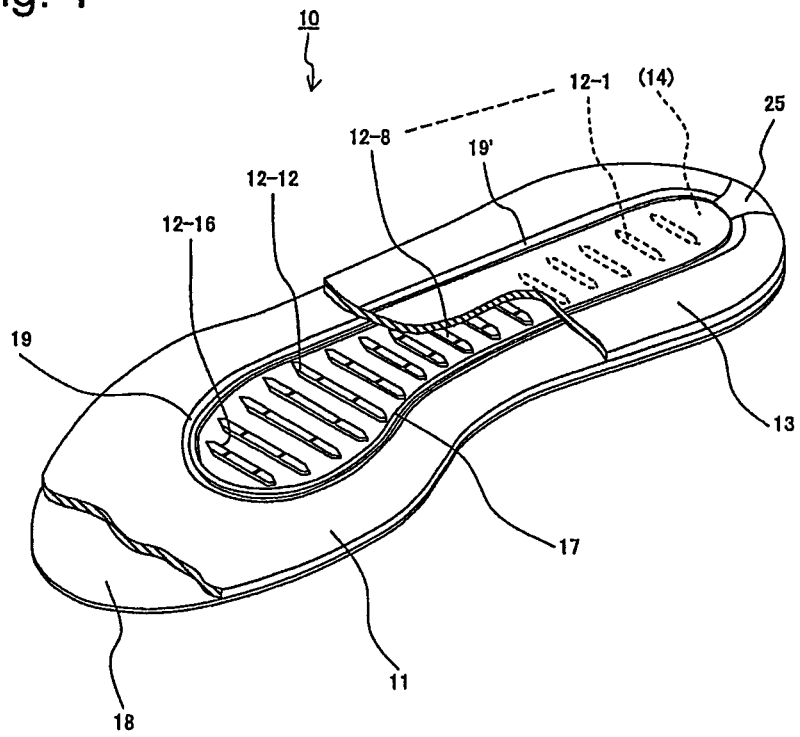
FIG. 1 is an external perspective view partially broken away of a shoe midsole according to a first embodiment.

FIG. 1 is an external perspective view partially broken away of a shoe midsole 10. The shoe midsole 10 has a sole plate 11, a cover 13 bonded to the sole plate 11 along the outer circumference with welding, etc., a fluid 14 sealed between the sole plate 11 and the cover 13, and a sheet 18 bonded on the back surface of the sole plate 11.

The sole plate 11 is made of a thermoplastic resin such as polyvinyl chloride resin, and is molded with injection molding, etc. A plurality of blades 12 are integrally formed on the sole plate 11. The details of the plurality of the blades 12 will be described later. The sole plate 11 is bonded to the cover 13 via their respective welding surfaces 19, 19'. The sole plate 11 and the cover 13 are made of same kind of thermoplastic resins.

However, the sole plate 11 and the cover 13 can be made of different type of materials so far as they can be bonded together. The fluid 14 preferably has low water permeability, low-level evaporation, high fluidity and anti-deterioration. This fluid 14 is infused through an inlet 25 in the heel side.

As the fluid 14, for example, a water mixed with antifreeze liquid is preferably used so that the fluid 14 can not freeze in cold regions. In the first embodiment, propylene glycol is used as the fluid 14.

The sheet 18 is bonded to the sole plate 11 to reduce discomfort during walking by preventing the fluid 14 from leaking to the outside even if the fluid 14 breaks through the sole plate 11. Also, the sheet 18 is made of, for example, a thermoplastic resin. If there is no possibility that the fluid 14 will break through the sole plate 11, the sheet 18 can be omitted.

Figure 2:
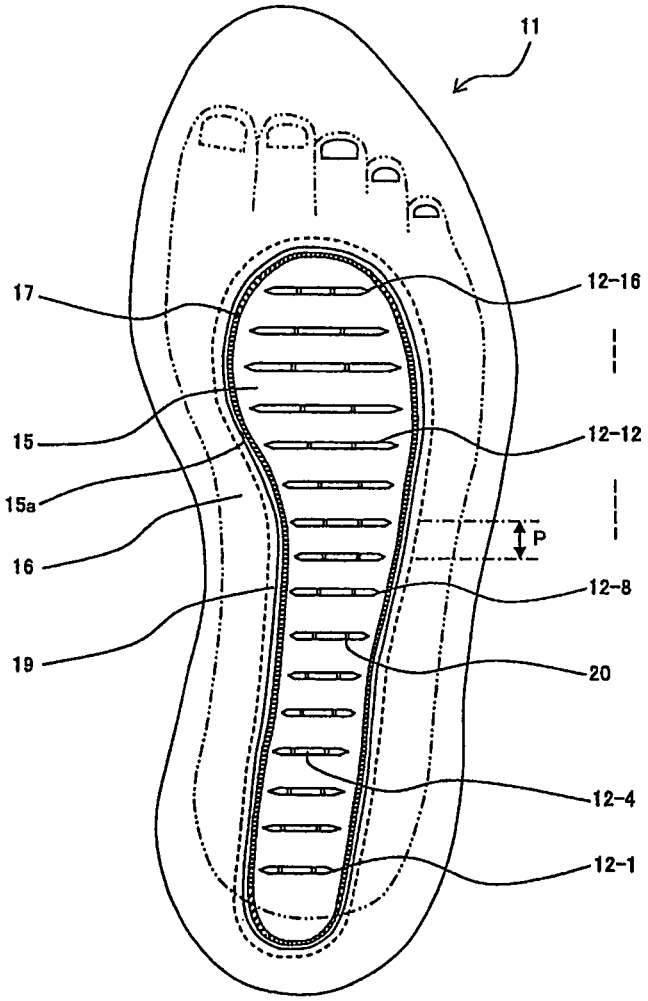
FIG. 2 is a top view of a sole plate.

FIG. 2 is a top view of the sole plate 11.

As illustrated in FIG. 2, a first concave part 15 having an equivalent shape (similar shape) to a sole of a foot is formed on the upper surface of the sole plate 11. Moreover, a circumference 16 is formed so as to surround the first concave part 15 via an inner wall 15*a* and the welding surface 19. The welding surface 19 is formed on a thick part 23 (see FIG. 4). Some area of the first concave part 15 on the toe side may extend to the base of the toes. Desirably, however, the toe side of the first concave part 15 does not extend to the base of the toes, so as to facilitate walking.

Additionally, a partition 17 standing on the sole plate 11 is successively formed inside of the first concave part 15. The detail of the partition 17 will be described later. The partition 17 is hatched in FIG. 2 in order to be easily distinguished from the other parts.

Furthermore, plurality of blades 12-1 to 12-16 are arranged so as to integrally stand on the first concave part 15. The plurality of blades 12 are aligned at a predetermined interval along a direction nearly orthogonal to the longitudinal direction of the sole plate 11. In the first embodiment, all of the blades 12-1 to 12-16 are respectively aligned at a nearly equal interval from the heel to the toe.

The blades 12 have an important function to adequately stimulate the pressure points on the sole of a foot owing to its nature of the elastic material. It is known that many pressure points related to physical health are concentrated on the sole of a foot.

A collaborative action of the elastic force of the blades 12 and the fluid 14 absorbs a shock applied to the sole of a foot, and also stimulates and massages the pressure points adequately during walking.

FIG. 3 is a cross-sectional view of the sole plate 11 and the cover 13 bonded thereto when being cut along the longitudinal length.

As shown in FIG. 3, at least some of the plurality of blades 12-1 to 12-16 are arranged so as to be uniformly tilted toward the toe side. This embodiment represents a case where all of the blades 12-1 to 12-16 are arranged to be tilted toward the toe side.

Namely, all of the blades 12-1 to 12-16 are arranged to be uniformly tilted toward the toe side at an angle θ (approximately 45 degrees) with respect to a direction y-y nearly orthogonal to the longitudinal direction of the sole plate 11. In this embodiment, approximately 45 degrees is selected as the angle θ. However, the angle θ is not limited to 45 degrees.

As shown in FIG. 3, a level difference h1 is provided between the first concave part 15 and the circumference 16. Moreover, the thick part 23 is formed along the inside of the circumference 16 of the sole plate 11 as the bonded (welded) area with the cover 13. The thick part 23 has the welding surface 19. Moreover, a tilted inner wall (tilted surface) 15*a* and a tilted outer wall (tilted surface) 15*b* are formed along the boundary between the first concave part 15 and the circumference 16. The reason why the level difference h1 is provided is to prevent the sole plate 11 from distortion.

Additionally, a second concave part 21 is formed on the cover 13 so as to face the first concave part 15. A level difference h2 is provided between the second concave part 21 and a circumference 22 formed to surround the second concave part 21. Moreover, a tilted inner wall (tilted surface) 21*a* and a tilted outer wall (tilted surface) 21*b* are formed along the boundary between the second concave part 21 and the circumference 22. A welding surface 19' (surface to be welded) is formed along inside of the circumference 22, facing the welding surface 19 of the sole plate 11.

In this embodiment, the welding surface 19 of the circumference 16 of the first concave part 15 and the welding surface 19' of the circumference 22 of the second concave part 21 are welded. The reason why the level difference h2 is provided is to prevent the cover 13 from distortion.

In this way, the welding surface 19 of the sole plate 11 and the welding surface 19' of the cover 13 are welded so as to combine the cover 13 with the sole plate 11. When the sole plate 11 and the cover 13 are welded, the welding area melts and then reduces its thickness. Therefore, the thick part 23 having large thickness is formed on the sole plate 11.

The width (horizontal width) of the thick part 23 is formed to be slightly wider than the width of the welding surface 19. This is because water leakage possibly occurs through the welding area of the sole plate 11 if the width of the thick part 23 is narrower than that of the welding surface 19.

As described above, the sole plate 11 and the cover 13 are welded to be sealed in the shape of a bag, in which said fluid 14 is sealed.

The inlet part 25 (see FIG. 1) is left without being welded. And the outside of the welding surface 19 is left without being welded.

In this embodiment, it is described that the tilted surfaces 15*a*, 15*b* are formed along the boundary between the first concave part 15 and its circumference 16, and the tilted surfaces 21*a* and 21*b* are formed along the boundary between the second concave part 21 and its circumference 22. However, these tilted surfaces can be changed to arc-shaped surfaces or curved surfaces.

In the meantime, the sole of a foot of a human being is so sensitive as to feel uncomfortable when a small stone rests on the bottom of a shoe for example. Therefore, it is especially desirable that the welding surface 19' of the cover 13 is preferably maintained in flat surface condition without unevenness after the thick part 23 is welded.

In this embodiment, as the welding surfaces 19, 19' are welded together with a nearly equal width, the bonding strength can be uniform, then the water leakage can be prevented and the flat surface condition can be maintained without causing twist etc. on the shoe midsole 10 as a whole. And in this embodiment, the thick part 23 is formed to have a uniform width. This is because the welding surfaces 19, 19' are welded with an almost uniform width. Furthermore, non-welding surfaces surrounding the welding surfaces 19, 19' are spot-welded together at several points, and sand and dust can be prevented from entering into the gap between the sole plate 11 and the cover 13.

FIG. 4 is a cross-sectional view of the sole plate 11 and the cover 13 when being cut along a direction nearly orthogonal to the longitudinal direction of the sole plate 11.

As shown in FIG. 4, both ends of the upper surface of the blade 12 are formed in a shape of moderately curved arc each other, and edges of both sides of the blade 12 do not reach the partitions 17 formed along the inside of the circumference of the first concave part 15. Moreover, grooves 20 are formed on the upper surface of the blade 12 between its both ends. The grooves 20 are formed so that the fluid 14 can move in the longitudinal direction of the sole plate 11. In this embodiment, the two grooves 20 are formed at a predetermined interval on every blade 12.

The number of grooves 20 is not particularly limited. Moreover, the cross-section of the groove 20 is formed in the shape of a rectangle in this embodiment. However, the shape of the groove 20 may not particularly be limited. The shape of cross-section of the groove 20 can be semi-circular or U-shaped. Additionally, the grooves 20 are formed on the upper surface (the surface near the cover 13) of the blade 12 in this embodiment. However, the grooves 20 can be formed on the bottom side (the side facing the first concave part 15).

As shown clearly in FIG. 4, the inner wall 15*a* of the sole plate 11 is formed to be continuously and gradually tilted up toward the circumference 16. By forming the inner wall 15*a* to be tilted in this way, the fluid 14 can be smoothly moved, and the inner wall 15 can be prevented from getting pressure. The cover 13 has the similar characteristics.

Additionally, the partition 17 described above is formed to integrally stand on the sole plate 11 along the inside of the circumference of the first concave part 15 between both ends of the blade 12 and the inner wall 15*a* of the first concave part 15.

The partitions 17 have a function to prevent the fluid 14 from leaking by preventing the fluid 14 from directly contacting the respective welding surfaces 19, 19' (see FIG. 1) of the sole plate 11 and the cover 13. In this embodiment, it is one of the important subjects to prevent the fluid 14 from leaking.

For example, the fluid 14 within the concave parts 15, 21 moves with high pressure when the toes kick the ground during walking. The partitions 17 has the function to prevent the fluid 14 having high pressure from breaking through and leaking through the respective welding surfaces 19, 19' of the sole plate 11 and the cover 13.

It is because the impact force applied to the shoe midsole at the movement of a body weight during walking is beyond understandable level based on the common sense. In this embodiment, the horizontal position of the top surface of the partitions 17 is nearly equal to the horizontal position of the upper surface of the circumference 16 of the sole plate 11.

Considering the walking actions, a heel portion of the foot touches down on the ground at first, and the area contacting the ground is expanding toward an arch of a foot, and after bearing the body weight on a swelled portion (ball portion) of the base of the toes, the toes horizontally spread to suppress a stagger in the horizontal or vertical direction. Next, the base of the toes starts to bend the ball portion while the center of gravity moves forward, then the heel portion goes up, and all the toes kick the ground. At this time, the fluid 14 sealed inside moves to evenly absorb and reduce the shock of touch-down on the shoe midsole 10 of this embodiment.

In this regard, when a pressure is partially applied to a liquid sealed within a container, for example, the pressure is spread to all the inner surfaces of the container (Pascal's Law). Therefore, based on the above, when the shoe midsole 10 of this embodiment is used, a water pressure equal to or higher than a body weight of a person is evenly applied to all over the surface contacting the cover 13. Moreover, the elastic force of the plurality of blades 12 is relieved by the movement of the fluid 14.

Figure 5:
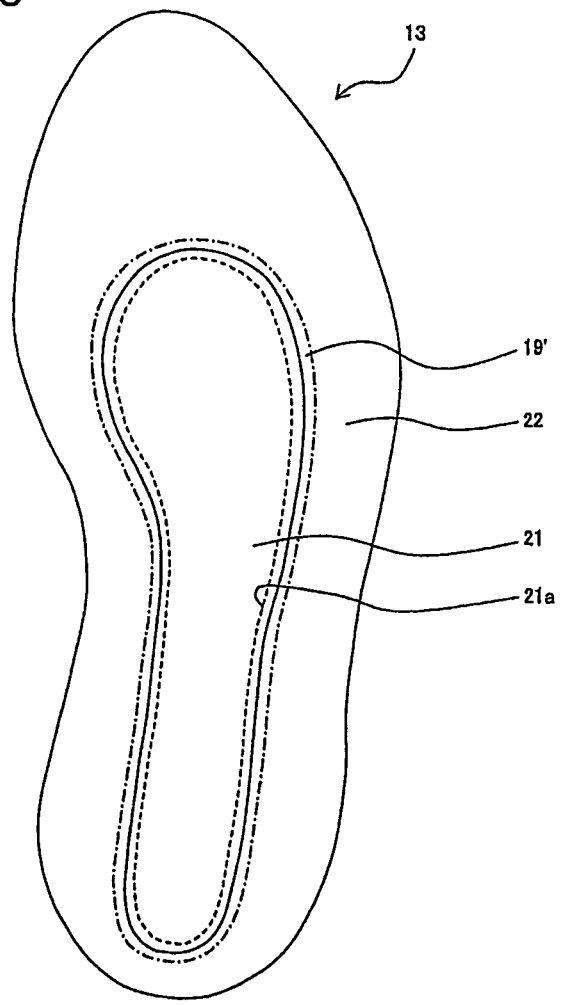
FIG. 5 is a top view of the cover when viewed in the V direction shown in FIG. 3.

FIG. 5 is a schematic illustrating the cover 13 when viewed in a V direction shown in FIG. 3.

As described above, the second concave part 21 of the cover 13 is formed correspondingly to the first concave part 15 of the sole plate 11. A circumference 22 is formed along the outside of a circumference of the second concave part 21 via the inner wall 21*a* and the welding surface (surface to be welded) 19'.

The respective planar shapes of the second concave part 21 and the circumference 22 are nearly equal to those of the first concave part 15 and the circumference 16 of the sole plate 11. The thickness of the circumference 22 is nearly equal to that of the circumference 16 of the sole plate 11 except the thick part 23.

Additionally, an uneven pattern such as a mat pattern or a pear-skin pattern is formed on the upper surface of the cover 13 when needed, although this is not illustrated in FIG. 5. The uneven pattern can prevent sweat from gathering as droplets on the upper surface of the cover 13, and can promote diffusion and evaporation of the droplets.

After the sole plate 11 and the cover 13 are welded together, the fluid 14 is infused through the inlet 25 (see FIG. 1) into the space enclosed with the first concave part 15 and the second concave part 21. Thereafter, the inlet 25 is welded to seal the fluid 14.

Figure 6:
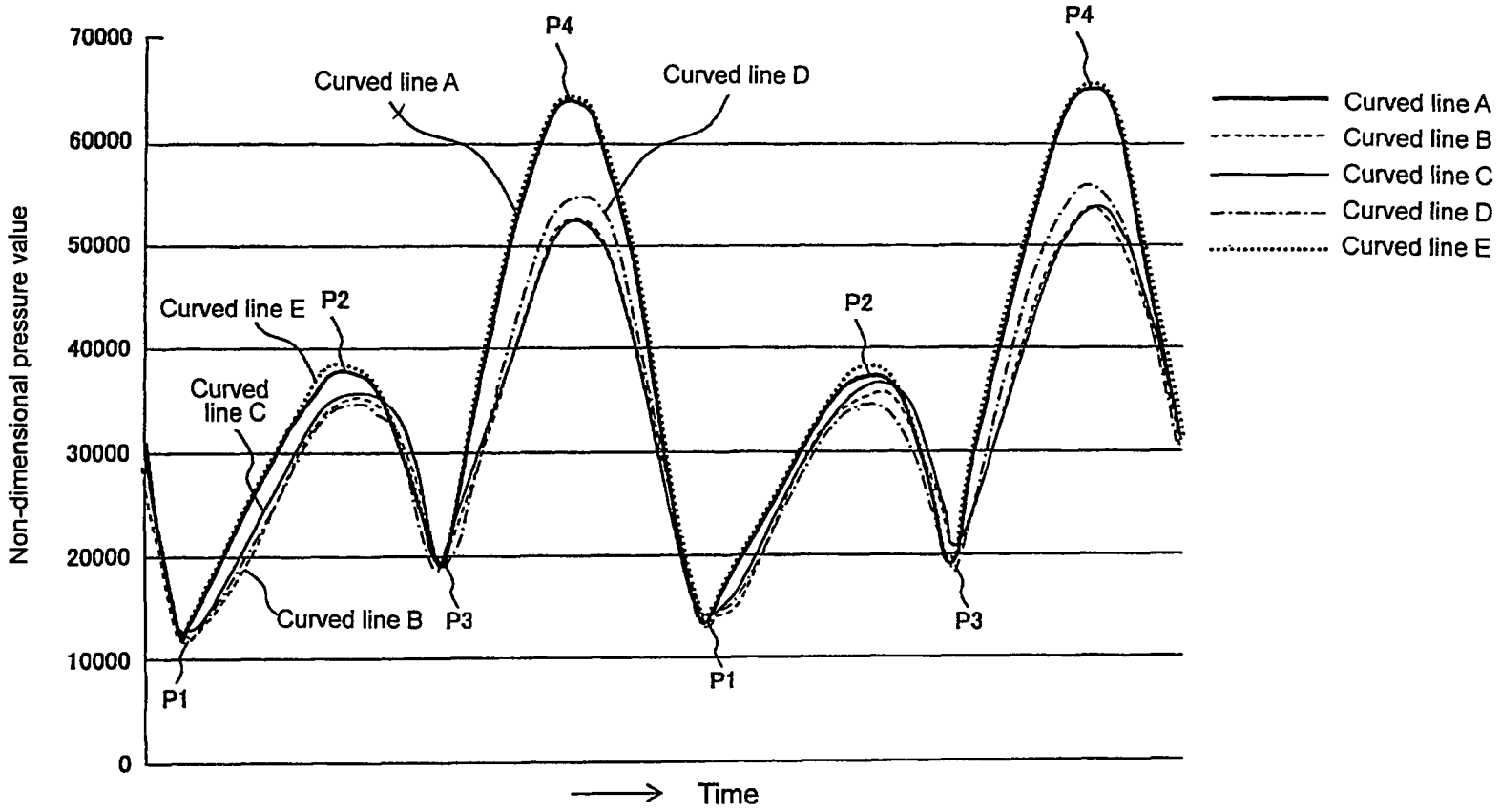
FIG. 6 is a graph illustrating pressure applied to a sole of a foot during walking simulation in a case where all or some of the blades are tilted toward a toe.

FIG. 6 is a graph illustrating changes in a pressure applied to a sole of a foot when a walking simulation is performed in the case of tilting all or some of the blades 12 toward the heel or the toe.

In this figure, the horizontal and the vertical axes represent time and a (non-dimensional) pressure value applied to the sole of a foot at that time, respectively.

In this embodiment (the first embodiment), all of the blades 12-1 to 12-16 were uniformly tilted toward the toe (curved line A), and a tilting angle was changed (curved line B).

Changes in the pressure applied to the sole of a foot at this time were represented with the curved line A (solid thickened line) and the curved line B (dotted line).

A curved line E (dotted line) represents, as a comparison example, the case where the blades 12 were uniformly tilted toward the heel side. A curved line C (solid thin line) and a curved line D (dashed-dotted line) will be later described in the second and the third embodiments.

A point P1 in this figure indicates a pressure applied to the sole of a foot just before the heel of the foot touched down on the ground during walking. Then the touchdown of the heel terminated at a point P2 (the body weight was applied). Next, a point P3 indicates a pressure applied to the sole of a foot while the body weight was transferred from the heel to the toe side. A point P4 indicates a pressure applied when the toes kicked the ground (the body weight was applied). After the toes kicked the ground, the body weight was transferred and then the heel of the foot went to the point P1 in the next step. The above was one cycle of walking of a person.

Here, the curved line A represents the pressure applied to the sole of a foot in the case where the blades 12 formed on the sole plate 11 were uniformly tilted toward the toe side at an angle $\alpha$ (such as 10 degrees).

The curved line B represents the pressure applied to the sole of a foot in the case where the blades 12 were uniformly tilted toward the toe side at an angle $\theta$ (such as 45 degrees) ($\theta>\alpha$).

The curved line E represents changes in the pressure applied to the sole of a foot in the case where the blades 12 were uniformly tilted toward the heel side at the angle $\alpha$ (such as 10 degrees).

On the curved line A, the pressure (point P2) applied at the moment of touchdown of the heel on the ground was approximately 38000 (non-dimensional), and the pressure (point P4) applied at the moment of kicking the ground of the toes was 64000. In contrast, on the curved line B, the pressure (point P2) applied at the moment of touchdown of the heel on the ground was approximately 35000, and the pressure (point P4) applied at the moment of kicking the ground of the toes was 53000.

According to the above result, the case of the curved line A where the blades 12 have the smaller tilting angle (angle $\alpha$) is higher than the case of the curved line B where the blades 12 have the larger tilting angle (angle $\theta$) both in the pressure (point P2) applied at the moment of touchdown of the heel on the ground and in the pressure (point P4) applied at the moment of kicking the ground of the toes.

The reason of the above is considered that the pressure directly applied to the sole of a foot became higher in the case having the small tilting angle (angle $\alpha$) of the blades 12 as shown in the curved line A In the meantime, on the curved line E, the pressure (point P2) applied at the moment of touchdown of the heel on the ground was approximately 39000 (non-dimensional), and the pressure (point P4) applied at the moment of kicking the ground of the toes was 64000.

Namely, though the curved line E is almost the same as the curved line A as a whole, the pressure (point P2) applied at the moment of touchdown of the heel on the ground on the curved line E was slightly higher than that on the curved line A. Moreover, the pressure (point P4) applied at the moment of kicking the ground of the toes on the curved line E was nearly equal to that on the curved line A.

The reason why the pressure at the point P2 on the curved line E was slightly higher than that on the curved line A is considered that a pressure directly applied to the sole of a foot in the case where the blades 12 were tilted toward the heel side (curved line E) was higher than that in the case where the blades 12 were tilted toward the toe side (curved line A).

Additionally, the pressures at the point P4 on the curved lines A and E were nearly equal.

Furthermore, a difference between the pressure applied at the moment of kicking the ground of the toes (point P4) and the pressure applied at the moment of touchdown of the heel on the ground (point P2) was smaller on the curved line B than those on the curved lines A and E.

It is said that comfortable walking with less strain can be achieved in the case that the difference between the pressure applied at the moment of kicking the ground of the toes and the pressure applied at the moment of touchdown of the heel on the ground is smaller. From this viewpoint, it is proved that when the blades 12 are tilted toward the toe side, it is desirable to select slightly larger tilting angle (angle $\theta$) rather than to select smaller tilting angle (angle $\alpha$).

The reason of the above is considered that if the blades 12 are arranged to be uniformly tilted toward the toe, a resistance is given to the sealed fluid 14 in the opposite direction of the movement of the fluid 14 due to the reverse tilting angle of the blades 12, especially when the toes kick the ground, and the resistance suppresses rapid movement of the fluid 14 from the toe side to the heel side.

Namely, as illustrated in FIG. 6, although the toes kick the ground after the heel touches down on the ground during walking, the touchdown force of the heel is smaller than the kicking force of the toes. Therefore, the moving speed of the fluid 14 from the heel side to the toe side is rather slower when the heel touches down on the ground. In contrast, as the force generated at the moment of kicking the ground of the toes is large, the moving speed of the fluid 14 from the toe side to the heel side is very fast when the toes kick the ground.

However, in this embodiment (curved lines A and B), as the blades 12 are uniformly tilted toward the toe side, a resistance in the opposite direction of the movement of the fluid 14 is given to the fluid 14 when the fluid 14 moves from the toe side to the heel side at the time when the toes kick the ground. From the above result, the moving speed of the fluid 14 slows down. In this way, the pressure applied to the sole of a foot (especially, the pressure applied when the toes kick the ground) can be reduced.

Additionally, in this embodiment, the shape of the first concave part 15 of the sole plate 11 (and the second concave part 21 of the cover 13) is formed to be similar to the sole of a foot (see FIG. 2). Consequently, the volume of the sealed fluid 14 in the toe side is larger than that in the heel side. Therefore, the fluid 14 attempts to move from the toe side to the heel side at high speed when the toes kick the ground. However, as the blades 12 are uniformly tilted toward the toe side and a resistance against the movement of the fluid 14 is generated, the movement of the fluid 14 to the heel side is suppressed when the toes kick the ground.

By the way, the optimum value of the tilting angle of the blades 12 has not been obtained at the present time. This is because when the tilting angle of the blades 12 changes, not only the pressure value applied to the sole of a foot but also influences of other elements (change in the flow path of the fluid 14, and ease of walking, etc.) are exerted, therefore, these factors should be considered together as a whole.

This embodiment refers to the case where the present invention is applied to the shoe midsole. However, the present invention is not limited to this implementation, and may be directly applied, for example, to the bottom of a shoe.

In this embodiment, the pressure applied at the moment of kicking the ground of the toes is reduced by arranging all the blades 12-1 to 12-16 to be uniformly tilted toward the toe, and then a shock transferred to the knee and the hips, etc. from the heel can be absorbed and a comfortable walking feeling can be produced. Though elastic force of the blades 12 actually massages the sole of a foot, the fluid 14 relieves the elastic force of the blades 12 and stimulates the sole of a foot, whereby comfortable walking can be continued for a long time.

The Second Embodiment

Figure 7:
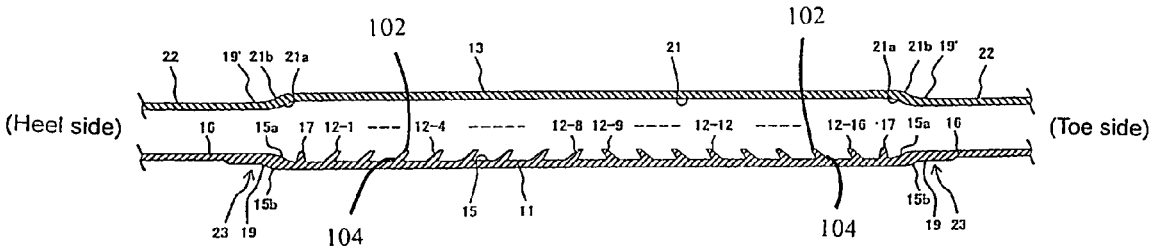
FIG. 7 is a fragmentary cross-sectional view of the sole plate and a cover when being cut along a longitudinal direction of the sole plate according to a second embodiment.

FIG. 7 is a cross-sectional view of the sole plate 11 and the cover 13 according to the second embodiment, cutting along the longitudinal direction. Members identical or equivalent to those in the first embodiment are denoted with the same reference numbers, and their descriptions are omitted.

In this embodiment, some of the blades 12 are arranged to be tilted toward the toe from the center of the longitudinal length of the sole plate 11 to the heel, and other blades are arranged to be tilted toward the heel from the center to the toe.

Namely, as illustrated in FIG. 7, the eight blades 12-1 to 12-8 are arranged to be uniformly tilted toward the toe at a predetermined angle θ (such as 45 degrees) from the center of the longitudinal length of the sole plate 11 to the heel, and the rest of the blades 12-9 to 12-16 are arranged to be uniformly tilted toward the heel at the predetermined angle θ (such as 45 degrees) from the center to the toe. Each blade 12 has a base 104 at the sole plate 11 and extends to a distal end 102. As shown in FIG. 7, distal ends 102 of the blades 12-1 to 12-8 are closer to the toe than the bases 104 of such blades; and distal ends 102 of the blades 12-9 to 12-16 are closer to the heel than the bases 104 of such blades.

The curved line C (solid thin line) illustrated in FIG. 6 represents changes in the pressure applied to the sole of a foot in this embodiment.

According to the curved line C, the pressure (point P2) applied at the moment of touchdown of the heel on the ground was approximately 36000, and the pressure (point P4) applied at the moment of kicking the ground of the toes was 53000. Namely, the difference between the maximum pressure at the time of kicking and that at the time of touchdown was 17000, therefore, the pressure difference was the smallest as to the curved lines illustrated in FIG. 6.

Therefore, comfortable walking with less strain can be also achieved in this embodiment.

The reason of the above is considered that a reverse resistance is applied to the fluid 14 by the blades 12 arranged from the center to the toe side to be uniformly tilted toward the heel side, though the fluid 14 sealed in the heel side moves from the heel to the center when the heel touches down on the ground. Accordingly, the fluid 14 in the heel side moves back and forth between the center and the heel, and the moving speed is slowed down, thereby the shock applied to the heel is reduced.

Next, a reverse resistance is applied by the blades 12 arranged from the center to the heel side to be uniformly tilted toward the toe side, even though the fluid 14 sealed in the toe side moves from the toe to the center when the toes kick the ground. Accordingly, the fluid 14 in the toe side moves back and forth between the center and the toe. Moreover, the moving speed is slowed down by the reverse resistance, thereby the shock applied to the toe is reduced.

According to this embodiment, the blades 12 arranged from the center of the longitudinal length of the sole plate 11 to the heel are uniformly tilted toward the toe, and the blades 12 arranged from the center to the toe are uniformly tilted toward the heel. Therefore, a resistance in the opposite direction of the movement of the sealed fluid 14 is applied to the fluid 14, thereby the rapid movement of the fluid 14 can be suppressed.

The Third Embodiment

Figure 8:
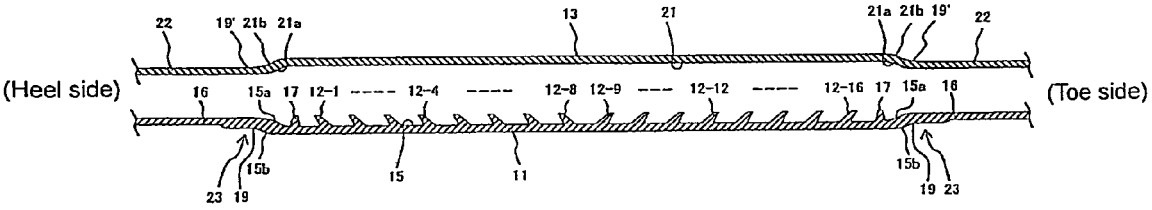
FIG. 8 is a fragmentary cross-sectional view of the sole plate and a cover when being cut along a longitudinal direction of the sole plate according to a third embodiment.

FIG. 8 is a cross-sectional view of the sole plate 11 and the cover 13 according to the third embodiment, cutting along the longitudinal direction. Parts identical to or equivalent to those of the first embodiment are denoted with the same reference numbers, and their descriptions are omitted.

In this embodiment, the blades 12 arranged from the center of the longitudinal length of the sole plate 11 to the heel are tilted toward the heel, and the blades 12 arranged from the center to the toe are tilted toward the toe.

In the second embodiment, the blades 12 arranged from the center of the longitudinal length of the sole plate 11 to the heel are tilted toward the toe. However, in the third embodiment the blades 12 arranged from the center to the toe are tilted toward the toe, and that is the different point from the second embodiment.

As illustrated in FIG. 8, the eight blades 12-1 to 12-8 arranged from the center of the longitudinal length of the sole plate 11 to the heel are uniformly tilted toward the heel at a predetermined angle θ (such as 45 degrees), and the blades 12-9 to 12-16 arranged from the center to the toe are uniformly tilted toward the toe at the predetermined angle θ (such as 45 degrees).

The curved line D (dashed-dotted line) illustrated in FIG. 6 represents changes in the pressure applied to the sole of a foot in this embodiment.

According to the curved line D, the pressure (point P2) applied at the time of touchdown of the heel on the ground was approximately 33000, and the pressure (point P4) applied at the time of kicking the ground of the toes was 55000. Namely, the difference between the maximum pressure at the time of kick and that at the time of touch down was 22000.

According to the curved line D, the difference between the maximum pressure at the time of kick and that at the time of touchdown was smaller than that of the curved line A. Therefore, comfortable walking with less strain can be expected to be achieved in a similar manner as in the first and the second embodiments.

The above is considered that when the toes kick the ground, a reverse resistance is applied to the fluid 14 sealed in the toe side by the blades 12 uniformly tilted toward the toe side between the center and the toe side, and also the moving speed of fluid is slowed down, whereby the large shock applied to the toe can be reduced.

And it is also considered that when the heel touches down on the ground, a reverse resistance is applied to the fluid 14 sealed in the heel side by the blades 12 uniformly tilted toward the heel side between the center and the heel side, and then the moving speed of fluid is slowed down, whereby the shock applied to the heel can be reduced.

Additionally, when the toe kicks the ground, a reverse resistance is applied to the fluid 14 sealed in the toe side by the blades 12 arranged from the center to the toe and uniformly tilted toward the toe, and then the moving speed of the fluid is slowed down, whereby the shock applied to the sole of a foot is reduced in a similar manner as in the above embodiments.

The Fourth Embodiment

FIGS. 9A, 9B, 10A and 10B are overall views and exploded perspective views of footwear (men's shoe 30 and women's shoe 40) according to the fourth embodiment.

This embodiment refers to the case where the shoe midsole 10 as a footwear midsole is arranged to be freely inserted and extracted on a footwear bases 31, 41 of the men's shoe 30 and the women's shoe 40. As portions other than the footwear bases 31, 41, insoles 34, 44, and the shoe midsole 10 do not directly relate to the present invention, any descriptions of them are omitted.

Figure 9A:
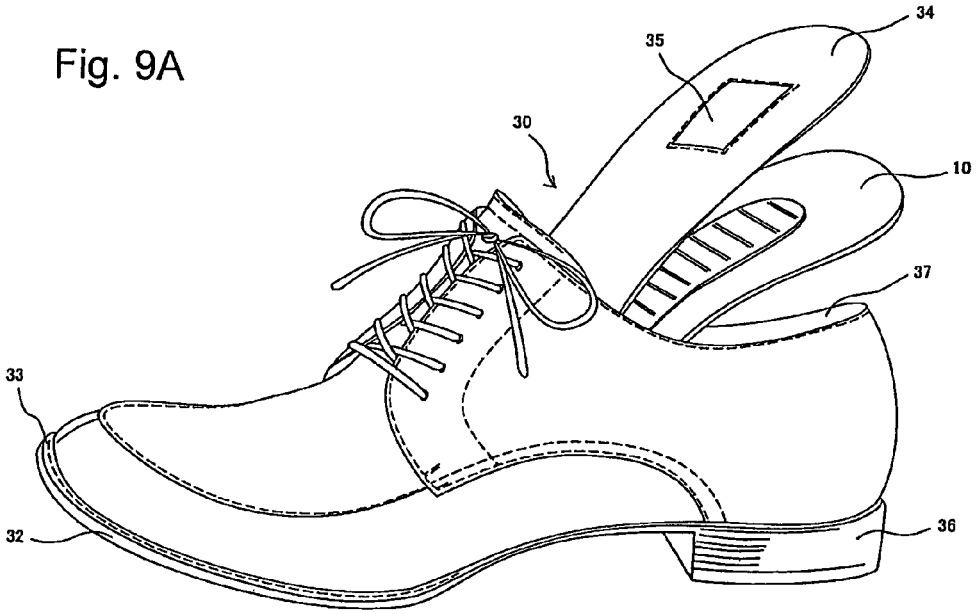
FIG. 9A is an overall perspective view of a men's shoe having a heel in a situation where a shoe midsole and an insole are inserted into an opening according to a fourth embodiment.
Figure 9B:
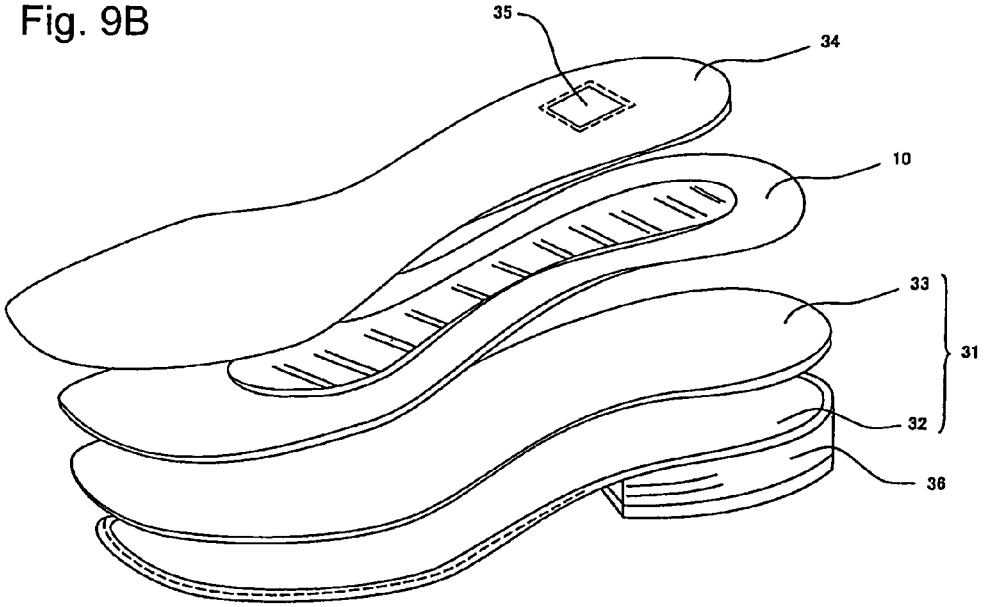
FIG. 9B is an exploded perspective view of a footwear base, the shoe midsole and the insole of a men's shoe.

FIG. 9A is an overall perspective view of the men's shoe 30 with a heel in the situation where the shoe midsole 10 and the insole 34 are inserted into a foot opening 37, and FIG. 9B is an exploded perspective view of the footwear base 31 of the men's shoe 30, the shoe midsole 10, and the insole 34.

The footwear base 31 of the men's shoe has an outsole 32 and a middle sole (midsole) 33. A heel 36 is made, for example, as an independent part by stacking a plurality of sheets of leather. The outsole 32 is the bottom portion of the shoe, and generally made of a high cushioning material. The middle sole 33 is also called a midsole, and mainly located to improve the stiffness, the anti-bending and the shock absorption of the shoe. The outsole 32 and the middle sole 33 are bonded with an adhesive, stitched with a thread, or united by being integrally molded. The insole 34 is made of, for example, one sheet of leather.

In this embodiment, the shoe midsole 10 and the insole 34 are detachably placed on the middle sole 33 in this order so as to be freely inserted into and extracted from the foot opening 37. Namely, the shoe midsole 10 and the insole 34 are placed without being adhered, etc. so that a customer can freely insert and extract them. The insole 34 is made of one sheet of leather, and a woven label 35 that displays the brand name of a manufacturer, etc. is stitched on the upper surface of the insole 34.

For actual use, the shoe can be used by removing the insole 34 according to customer's preference. In this case, the shoe is used in a condition where the shoe midsole 10 is exposed.

Figure 10A:
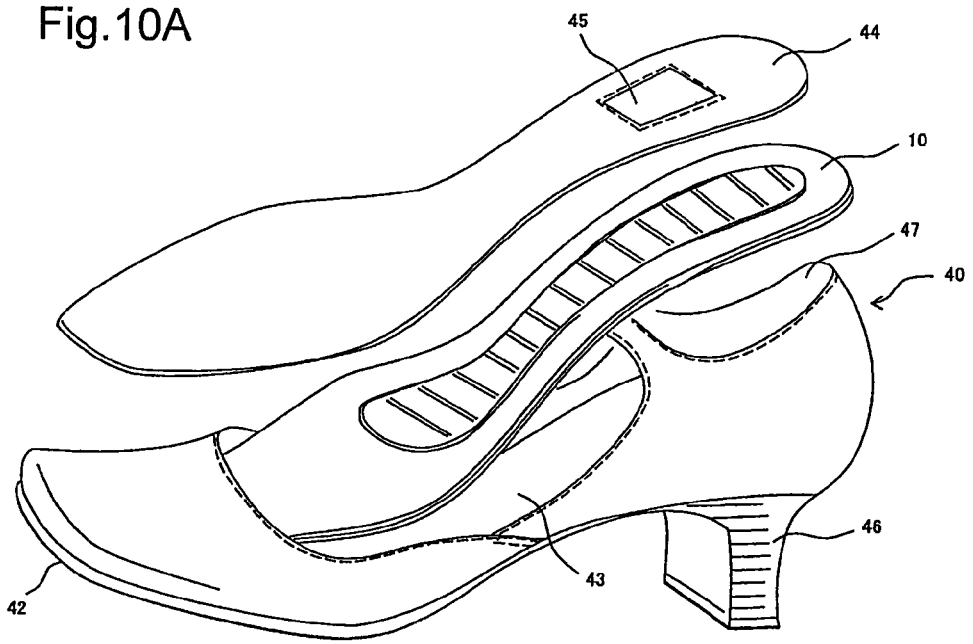
FIG. 10A is an overall perspective view of a women's shoe having a heel in a situation where a shoe midsole and an insole are inserted into an opening.
Figure 10B:
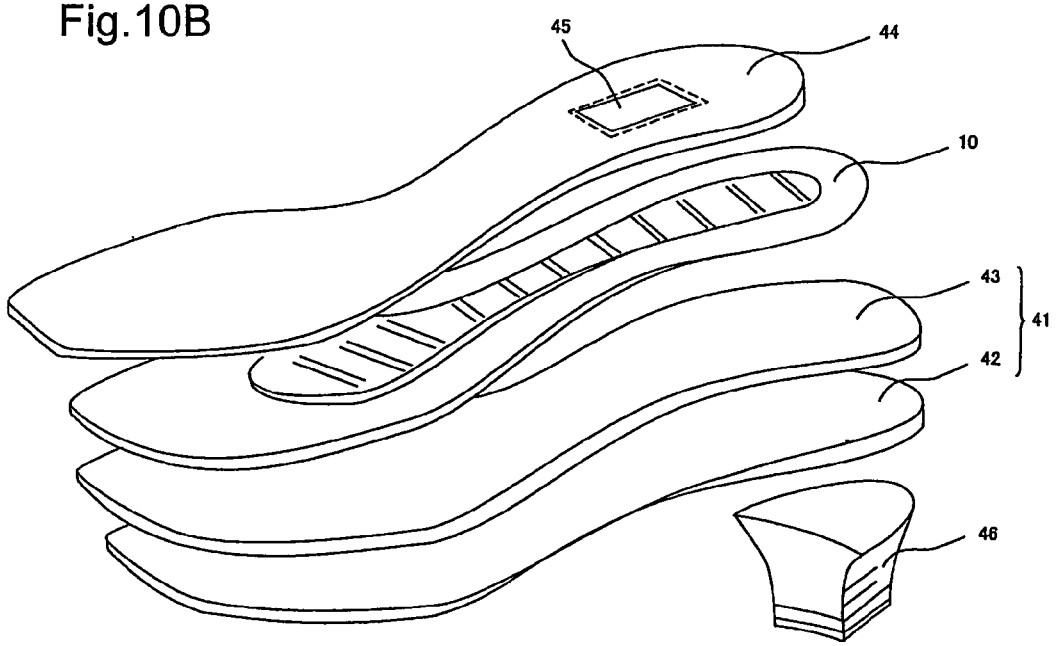
FIG. 10B is an exploded perspective view of a shoe footwear base, the shoe midsole and the insole of the women's shoe.

FIG. 10A is an overall perspective view of the women's shoe 40 with a heel in the situation where the shoe midsole 10 and the insole 44 are inserted into a foot opening 47, and FIG. 10B is an exploded perspective view of the footwear base 41 of the women's shoe 40, the shoe midsole 10 and the insole 44.

The footwear base 41 of the women's shoe 40 has an outsole 42 and a middle sole (midsole) 43. The outsole 42, the middle sole 43, the insole 44, a heel 46 and a woven label 45 are similar to those of the above described men's shoe 30. Therefore, their descriptions are omitted.

According to this embodiment, the shoe midsole 10 and the insole 44 are detachably placed on the middle sole 43 in this order so as to be freely inserted into and extracted from the foot opening 47. Namely, the shoe midsole 10 and the insole 44 are arranged without being adhered, etc. so that a customer can freely insert and extract them.

For actual use, the shoe can be used by removing the insole 44 according to customer's preference. In this case, the shoe is used in a condition where the shoe midsole 10 is exposed.

This embodiment refers to the case where the shoe midsole 10 is arranged on the footwear bases 31, 41 of the men's shoe 30 and the women's shoe 40 to be freely inserted and extracted. However, this embodiment is not limited to the above implementations. For example, the shoe midsole 10 can be arranged to be freely inserted into and extracted from other footwear such as a sport shoe, a sneaker, a strapped or non-strapped sandal, a business shoe, a ski shoe, a golf shoe, a hiking shoe, a walking shoe, a boot, a long boot, an indoor shoe, a Japanese sandal, a slipper, a sock, etc. If there is a portion covering the upper portion of the footwear base 31, 41, or a strap, the shoe midsole 10 does not come off easily even if it is arranged to be freely inserted and extracted.

According to this embodiment, as the shoe midsole 10 is arranged on the footwear bases 31, 41 of the men's shoe, etc. to be freely inserted and extracted, the midsole 10 can be easily installed in the men's shoe, etc. For example, if the effects of shock absorption and massage for the sole of a foot are desired to be improved during walking, the shoe can be used by removing the insoles 34, 44. Similarly, the shoe midsole 10 can reduce a burden on a foot, a knee, etc. in a standing position.

The Fifth Embodiment

FIGS. 11A to 11C and 12A to 12C are respectively external views, exploded perspective views, and a back view of footwear (men's shoe 50 or women's shoe 60) according to the fifth embodiment.

This embodiment refers to the case where the shoe midsole 10 as a footwear midsole is integrally bonded to respective footwear bases 51, 61 of the men's shoe 50 and the women's shoe 60. Portions other than the footwear bases 51, 61, insoles 54, 64, and the shoe midsole 10 do not directly relate to the present invention. Therefore, their descriptions are omitted.

Figure 11A:
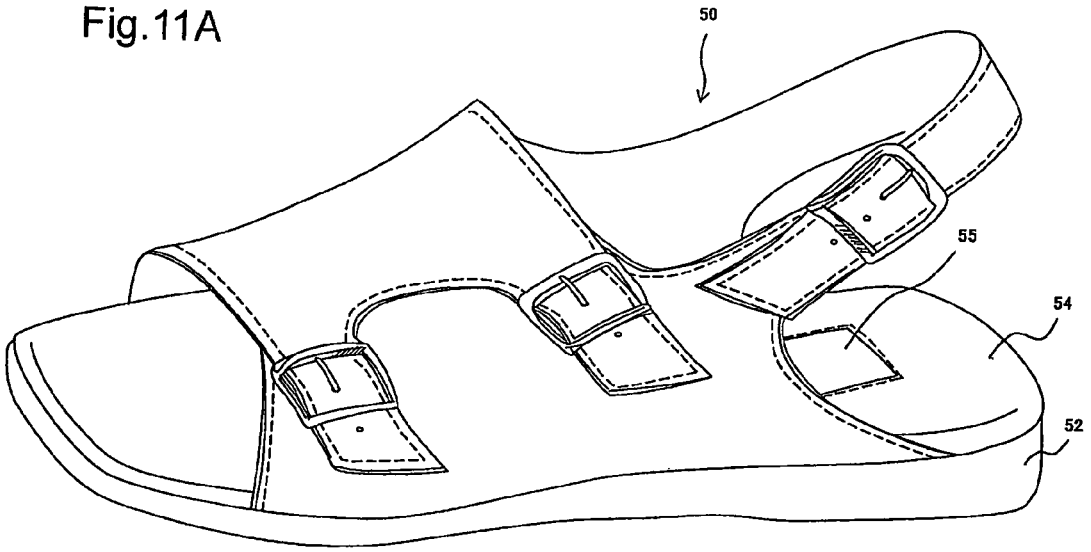
FIG. 11A is an overall perspective view of a men's shoe without a heel in a case where a shoe midsole is integrally fixed to a footwear base in a fifth embodiment.
Figure 11B:
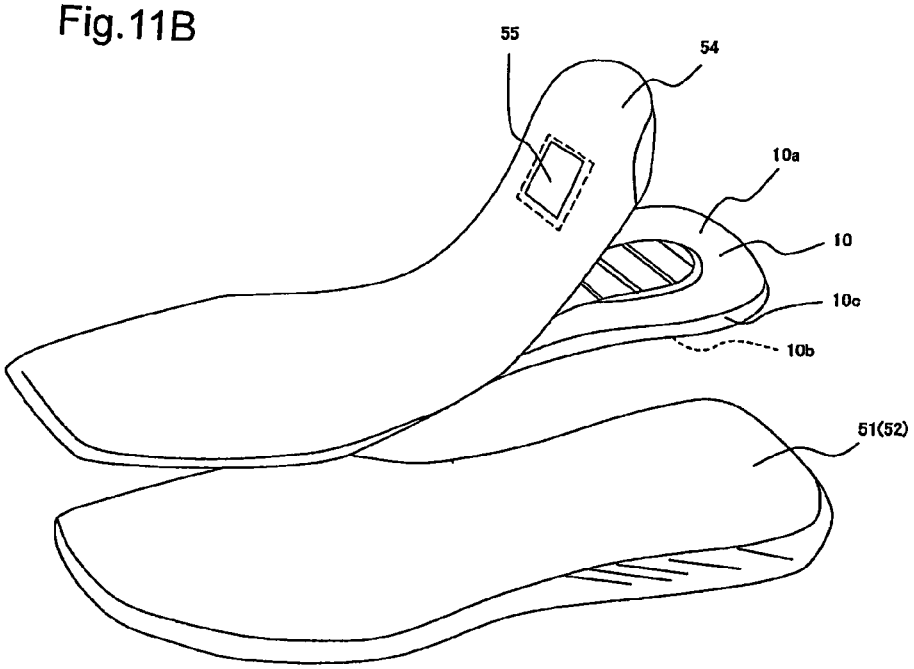
FIG. 11B is an exploded perspective view of the footwear base, the shoe midsole and the insole.
Figure 11C:
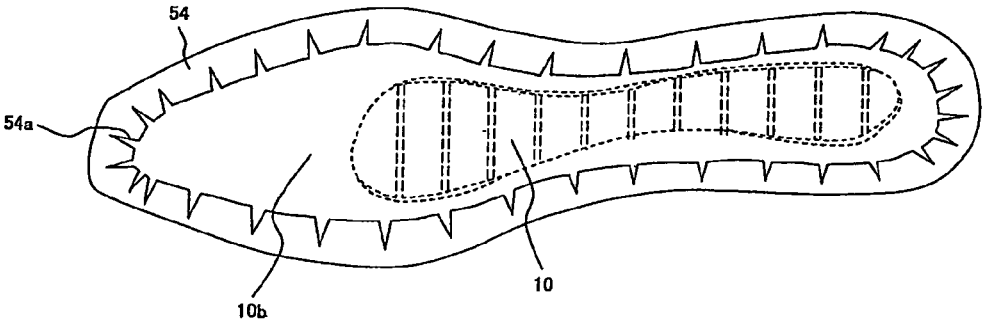
FIG. 11C is a back view of the shoe midsole covered by the insole, and fixed to the insole with an adhesive.

FIG. 11A is an overall perspective view of a situation where the shoe midsole 10 is integrally fixed to the footwear base 51 (having an outsole 52) of the men's shoe 50 without a heel. FIG. 11B is an exploded perspective view of the footwear base 51, the shoe midsole 10 and the insole 54. FIG. 11C is a back view of a situation where the shoe midsole 10 is covered with the insole 54 and fixed with an adhesive.

The footwear base 51 of the men's shoe 50 has the outsole 52. The outsole 52 is the bottom of the shoe and is made of, for example, a high cushioning material such as polyurethane, etc. Moreover, the insole 54 is made of, for example, one sheet of leather.

According to this embodiment, the shoe midsole 10 is covered with the insole 54 and is integrally fixed to the insole 54. Then, the shoe midsole 10 and insole 54 integrally fixed together are fixed on the outsole 52. Namely, an upper surface 10*a*, a side surface 10*c* and the outer circumference of a back surface 10*b* of the shoe midsole 10 are covered with the insole 54, and they are integrally bonded together with an adhesive coated on the circumferential part of the insole 54 (see FIG. 11C).

Furthermore, the shoe midsole 10 and the insole 54 integrated together are integrally bonded to the outsole 52 by using an adhesive coated both on the circumferential part of the insole 54 and on the back surface 10*b* of the shoe midsole 10. In this case, it is preferable that the shoe midsole 10, the insole 54 and the outsole 52 are bonded together by applying a pressure to the portions to be bonded. In this way, the shoe midsole 10 is integrally bonded on the back of the insole 54. As a result, the shoe midsole 10 is prevented from accidentally moving or coming off.

This embodiment refers to the case where the shoe midsole 10 and the insole 54 are bonded with the adhesive, and the insole 54 and the outsole 52 are also bonded with the adhesive. However, this embodiment is not limited to this implementation. For example, they may be stitched with a thread, or may be united with means such as welding, etc. Also this embodiment refers to the case where the shoe midsole 10, the insole 54 and the outsole 52 are bonded together with the adhesive coated on the circumferential part. However, for example, they may be bonded by coating the adhesive on the whole region of the facing areas. Moreover, the adhesive may be coated between the circumferential part of the upper surface 10*a* of the shoe midsole 10 and the insole 54 so as to bond the shoe midsole 10 and the insole 54

This embodiment refers to the case where the shoe midsole 10 is covered with the insole 54. However, this embodiment is not limited to this implementation. For example, the shoe midsole 10 may be bonded so that the side surface 10*c* of the shoe midsole 10 is exposed.

On the circumferential part of the insole 54, a plurality of slits 54*a* are formed at nearly equal intervals. The slits 54*a* are intended to adjust the length of the outer circumference to that of the inner circumference within the circumferential part. On the upper surface of the insole 54 (the side opposite to the welding surface of the shoe midsole 10), a woven label 55 that displays the brand name of a manufacturer, etc. is stitched.

Figure 12A:
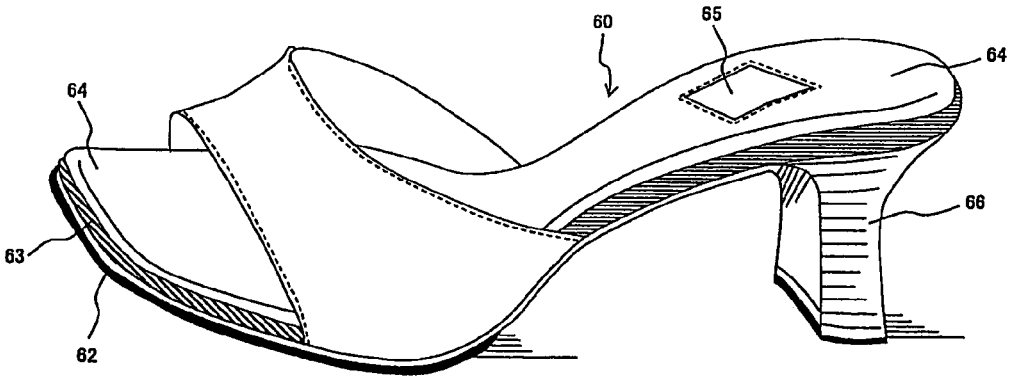
FIG. 12A is an overall perspective view of a women's shoe without a heel in a case where a shoe midsole is integrally fixed to a footwear base.
Figure 12B:
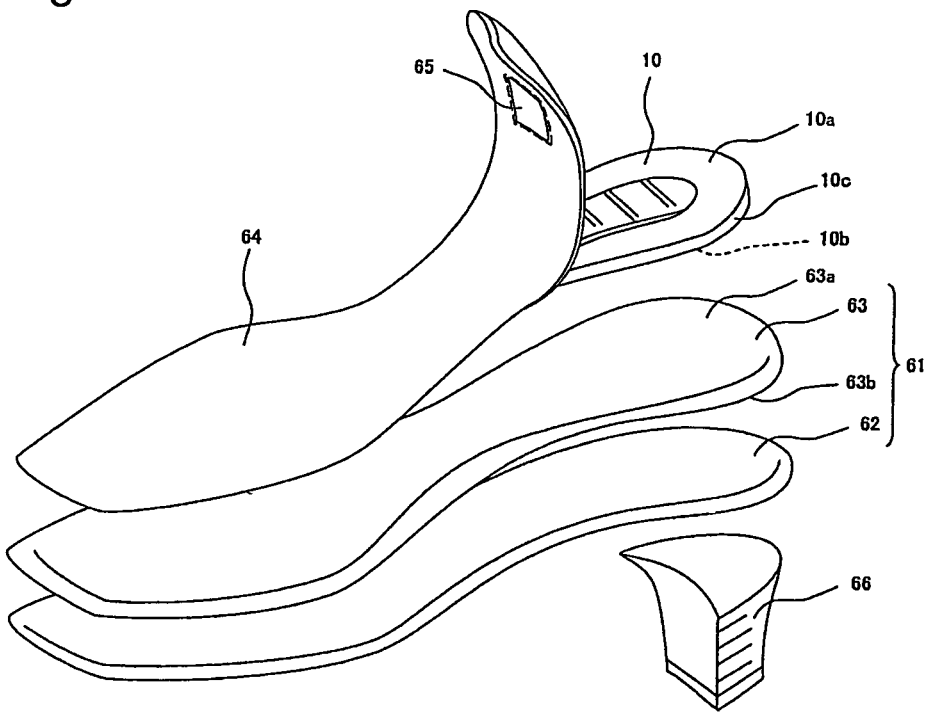
FIG. 12B is an exploded perspective view of a footwear base, the shoe midsole and the insole.
Figure 12C:
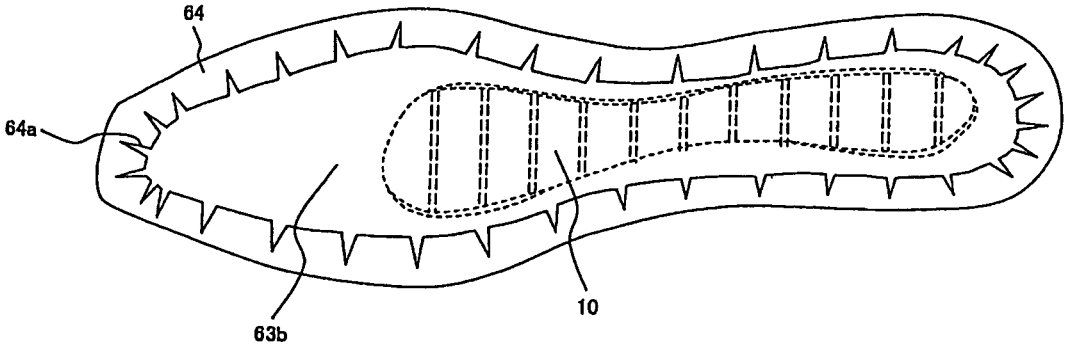
FIG. 12C is a back view of the shoe midsole covered by the insole, and fixed to the insole with an adhesive.

FIG. 12A is an overall perspective view of the situation where the shoe midsole 10 is integrally fixed to the women's shoe 60 without a heel. FIG. 12B is an exploded perspective view of a footwear base 61, the shoe midsole 10 and an insole 64. FIG. 12C is a back view of the situation where the shoe midsole 10 is covered with the insole 64 and fixed together with an adhesive.

The footwear base 61 of the women's shoe 60 has an outsole 62 and a middle sole 63.

The outsole 62, the middle sole 63, the insole 64, a heel 66 and a woven label 65 are similar to those of the above described men's shoe 30. Therefore, their descriptions are omitted.

According to this embodiment, the middle sole 63, the shoe midsole 10, and the insole 64 are integrally fixed in this order, and then the middle sole 63, shoe midsole 10 and insole 64 fixed integrally are fixed on the outsole 62. In this case, the back surface 10*b* of the shoe midsole 10 and an upper surface 63*a* of the middle sole 63 are united with an adhesive coated between them, and they are covered with the insole 64. Namely, the upper surface 10*a* of the midsole 10, the side surface 10*c* thereof, and the circumferential part of the back surface 63*b* of the middle sole 63 are covered with the insole 64 in the condition where the shoe midsole 10 and the middle sole 63 are united. Moreover, the shoe midsole 10, insole 64 and middle sole 63 integrally united together are bonded with an adhesive coated on the circumferential part of the insole 64 and the back surface 10*b* of the shoe midsole 10 (see FIG. 12C). In this case, it is preferable that the shoe midsole 10, the insole 64 and the middle sole 63 are bonded together by applying a pressure to their respective portions to be bonded.

Further, the middle sole 63 integrally united with the insole 64 and the shoe midsole 10 is integrally fixed to the outsole 62 with the adhesive coated on the back surface 63*b* of the middle sole 63 and the circumferential part of the insole 64.

This embodiment refers to the case where the shoe midsole 10 and the middle sole 63 are bonded with the adhesive, and the middle sole 63 and the outsole 62 are also bonded with the adhesive. However, this embodiment is not limited to this implementation. For example, they may be stitched with a thread or united with means such as welding, etc. Alternatively, the adhesive may be coated between the circumferential part of the upper surface 10*a* of the shoe midsole 10 and the insole 64, and then both of them are bonded.

The shoe midsole 10 is integrally bonded to the back side of the insole 64 in this way, thereby preventing the shoe midsole 10 from accidentally moving or coming off. This embodiment refers to the case where the shoe midsole 10 is covered with the insole 64. However, this embodiment is not limited to this implementation. For example, the shoe midsole 10 may be bonded so that the side surface 10*c* of the shoe midsole 10 is exposed.

On the circumferential part of the insole 64, a plurality of slits 64*a* are formed at nearly equal intervals. They are intended to adjust the length of the outer circumference to that of the inner circumference within the circumferential part of the insole 64. Moreover, a woven label 65 is stitched on the insole 64.

This embodiment refers to the case where the shoe midsole 10 is integrally fixed to the footwear base 51, 61 of the men's shoe 50 or the women's shoe 60. However, this embodiment is not limited to this implementation. For example, the shoe midsole 10 may be integrally fixed to other footwears such as a sport shoe, a sneaker, a strapped or non-strapped sandal, a business shoe, a ski shoe, a golf shoe, a hiking shoe, a walking shoe, a boot, a long boot, an indoor shoe, a Japanese sandal, a slipper, a sock, etc.

According to this embodiment, the shoe midsole 10 is integrally fixed to the footwear base 51, 61 of the men's shoe 50 or the women's shoe 60. Therefore, the shoe midsole 10 does not accidentally move or is not exposed. Therefore, it is not detected that the shoe midsole 10 is accommodated within the men's shoe 50 or the women's shoe 60 when viewed from the outside. With the shoe midsole 10, which is integrally bonded to the footwear base 51, 61 of the men's shoe 50 or the women's shoe 60 in this way, the effects of shock absorption and massage for a sole of a foot during walking can be obtained for a long period. Similarly, a burden on a foot, a knee, etc. in a standing position can be reduced with the shoe midsole 10.

The invention claimed is:

1. A shoe midsole, comprising:

a sole plate;

a plurality of blades integrally standing on the sole plate, each blade of the plurality of blades having a base at the sole plate and a distal end opposite the base;

a cover bonded to a circumference of the sole plate;

a fluid liquid sealed between the sole plate and the cover, and a first concave part in a shape equivalent to the sole of the foot formed on a surface of the sole plate, on which the plurality of blades stand, wherein the plurality of blades are accommodated within the first concave part, wherein the plurality of blades are aligned at a predetermined interval in a direction nearly orthogonal to a longitudinal direction of the sole plate, and wherein at least some blades of the plurality of blades are tilted so that each one blade of said at least some blades stands with said one blade's distal end closer to a toe than said one blade's base, so as to suppress a movement of the liquid from a toe side to a heel side when the toe kicks the ground, and thereby reduce a pressure applied to the sole of the foot when toes of the foot kick the ground.

2. The shoe midsole according to claim 1, wherein said at least some blades are first blades that are aligned between a center of a longitudinal length of the sole plate and a heel, and wherein second blades among said plurality of blades are aligned between the center and the toe and are tilted so that each one second blade of said second blades stands with said one second blade's distal end closer to the heel than said one second blade's base.

3. The shoe midsole according to claim 1, wherein said at least some blades are first blades that are aligned between a center of a longitudinal length of the sole plate and the toe, and wherein second blades among said plurality of blade are aligned between the center of the longitudinal length of the sole plate and the heel and are tilted so that each one second blade of said second blades stands with said One second blade's distal end closer to the heel than said one second blade's base.

4. The shoe midsole according to claim 1, wherein a groove through which the liquid can move is formed at a partway point in a longitudinal length of each of the plurality of blades.

5. The shoe midsole according to claim 1, wherein a partition integrally standing on the sole plate is formed along the inside of a circumference of the first concave part between both ends of the blade and the inner wall of the first concave part.

6. The shoe midsole according to claim 1, wherein a thick part is formed at a portion bonded to the cover along the circumference of the sole plate.

7. The shoe midsole according to claim 6, wherein the sole plate and the cover are adhered along the thick part with a nearly equal width.

8. The shoe midsole according to claim 1, wherein a level difference is provided between the first concave part and its circumference, a level difference is provided between a second concave part and its circumference formed respectively in the cover, the first concave part and the second concave part face each other, and the circumference of the first concave part and the circumference of the second concave part are welded.

9. The shoe midsole according to claim 8, wherein a tilting surface is formed along a boundary between the first concave part and the circumference of it, and a tilting surface is formed along a boundary between the second concave part and the circumference of it.

10. The shoe midsole according to claim 1, wherein the liquid is propylene glycol.

11. Footwear including a footwear midsole, placed on a footwear base, comprising:

a sole plate;

a plurality of blades integrally standing on the sole plate, each blade of the plurality of blades having a base at the sole plate and a distal end opposite the base;

a cover bonded to an outer circumference of the sole plate, and a liquid scaled between the sole plate and the cover, and wherein a first concave part in a shape equivalent to a sole of a foot is formed on a surface of the sole plate, on which the plurality of blades stand, wherein the plurality of blades accommodated within the first concave part are aligned at a predetermined interval in a direction nearly orthogonal to a longitudinal direction of the sole plate, and wherein each one blade of at least some blades of the plurality of blades stands with said one blade's distal end closer to a toe than said one blade's base, so as to suppress a movement of the liquid from a toe side to a heel side when the toe kicks the ground, and thereby reduce a pressure applied to the sole of the foot when toes of the loot kick the ground.

12. The footwear according to claim 11, wherein the footwear base comprises an outsole and a middle sole, and the footwear midsole and an insole are arranged on the middle sole in this order so as to be freely inserted and extracted.

13. The footwear according to claim 11, wherein the footwear base comprises an outsole, and an insole is integrally fixed on the footwear midsole, and the footwear midsole is fixed on the outsole.

14. The footwear according to claim 11, wherein the footwear base comprises an outsole and a middle sole, and the middle sole, the footwear midsole, and an insole are integrally fixed in this order, and the middle sole is fixed on the outsole.

15. The shoe midsole according to claim 1, wherein said at least some blades are first blades, and wherein for second blades among said plurality of blades each one second blade stands with said one second blade's distal end closer to the heel than said one second blade's base.

16. A shoe midsole configured to reduce pressure applied to a sole of a foot of a wearer of the shoe midsole when toes of said loot kick the ground, comprising:

a sole plate;

a plurality of blades integrally standing on the sole plate, each blade of the plurality of blades having a base at the sole plate and a distal end opposite the base;

a cover bonded to a circumference of the sole plate;

a liquid sealed between the sole plate and the cover, and a first concave part in a shape equivalent to the sole of the foot formed on a surface of the sole plate, on which the plurality of blades stand, wherein the plurality or blades are accommodated within the first concave part, wherein the plurality of blades are aligned at a predetermined interval in a direction nearly orthogonal to a longitudinal direction of the sole plate, and wherein at least some blades of the plurality of blades arc tilted so that each one blade of said at least some blades stands with said one blade's distal end closer to a toe than said one blade's base, so as to suppress a movement of the liquid from a toe side to a heel side when the toe kicks the ground, and thereby provide cushioning with said liquid to reduce said pressure applied to the sole of the foot when the toes kick the ground.

* * * * *